United States Patent [19]

Santoni

[11] 4,134,609

[45] Jan. 16, 1979

[54] DRUM CONTAINER CLOSING RING ASSEMBLY

[75] Inventor: Cesar Santoni, Hamilton, Canada

[73] Assignee: Greif Bros. Corporation, Delaware, Ohio

[21] Appl. No.: 827,328

[22] Filed: Aug. 24, 1977

[51] Int. Cl.[2] ..... E05C 19/18

[52] U.S. Cl. ..... 292/256.67; 85/32 R

[58] Field of Search ..... 292/256.67, 251; 85/32 R; 24/279–286

[56] References Cited

U.S. PATENT DOCUMENTS

| | | | |
|---|---|---|---|
| 3,069,741 | 12/1962 | Henning | 24/279 |
| 3,447,825 | 6/1969 | Santoni | 292/256.67 |
| 3,458,217 | 7/1969 | Pride, Jr. et al. | 24/279 |
| 3,659,491 | 5/1972 | Duffy et al. | 85/32 R |

*Primary Examiner*—Richard E. Moore

*Attorney, Agent, or Firm*—Kane, Dalsimer, Kane, Sullivan and Kurucz

[57] ABSTRACT

The disclosure is of a closing ring assembly for sealing the cover of a drum type of container. The assembly comprises a split ring, the ends of which are connected by a bolt secured through a pair of bolt clips mounted on the ends of the split ring. The bolt clips comprise tubular members having flared open ends. The clips are positioned in a specific manner to receive the bolt component without interfering with rolling of the drum. In a preferred embodiment, the bolt clips include a threaded retainer member to cooperate with a threaded bolt. The assembly of the invention is advantageous in that it is more economical to manufacture, more secure in use, easier to operate and stronger than prior art closing ring assemblies.

5 Claims, 14 Drawing Figures

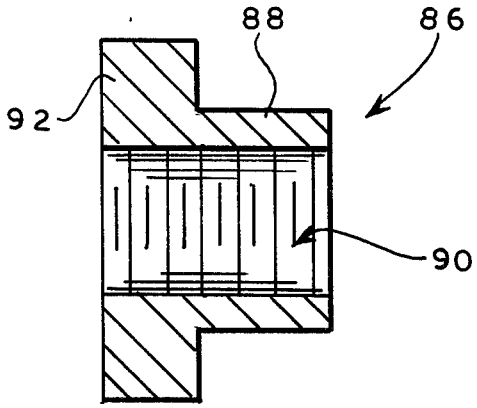
FIG. 13
FIG. 14
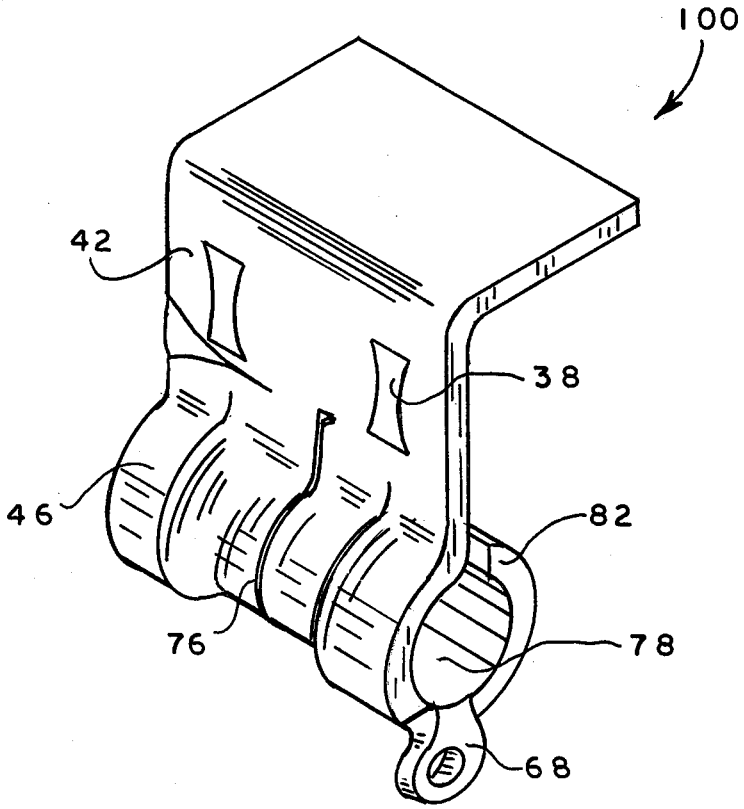

DRUM CONTAINER CLOSING RING ASSEMBLY

BACKGROUND OF THE INVENTION

1. Field of the Invention

The invention relates to methods and means of sealing drum type containers and more specifically relates to closing ring assemblies for releasably securing a cover or head on the drum container.

2. Brief Description of the Prior Art

There are a wide variety of drum type containers such as drums made of sheet metals, for example aluminum, steel and the like; drums made of convolutely wound, laminated layers of fibrous sheet materials, for example sheets of woven glass yarns and the like; and composite drums of combinations of such materials, for example drums having an outer shell of polymeric fibers and an inner shell or liner of sheet metal or polymeric resin such as polyvinyl chloride. Such drums are commonly used to ship a wide variety of materials, particularly raw materials and chemicals in bulk. These materials are generally in powdered or liquid form. For safety, health and economic reasons it is important to prevent loss of the contained materials through leakage or sifting. For this reason the covers or heads of the drum containers are usually made of sheet metal and are provided with a peripheral flange which overlaps the chime on the drum. A split closing ring is applied to the assembled cover and drum body. This ring has heretofore included a locking mechanism which constricts the ring to releasably secure the cover to the drum body. Representative of the split ring closing assemblies of the prior art is that described in U.S. Pat. No. 3,447,825.

SUMMARY OF THE INVENTION

The invention comprises a closing ring assembly for releasably securing a cover on a drum container of the type in which the upper surface of the container chime is overlapped by a peripheral flange of the cover which presents an upwardly facing rounded shoulder forming an upwardly facing first cam surface, said container having a rounded shoulder in its outer surface spaced downwardly a distance beneath the top of the chime and forming a downwardly facing second cam surface, which comprises:

a split ring formed of a flexible material and having a diameter less than the diameter required to encircle the top of the drum container with the cover in place but sufficient to bring the ends of said split ring in proximity to each other whereby bolt clips mounted on said ends as will be described hereinafter can be joined by a bolt, said split ring having an inner surface adapted to mate with and engage the first and second cam surfaces;

a first bolt clip mounted on said split ring adjacent to the first end of said split ring;

a second bolt clip mounted on said split ring adjacent to the second end of said split ring;

each of said bolt clips comprising a tube having flared, open first and second ends and a bore communicating between said tube ends;

said mounting of the first and second bolt clips positioning them so as to be cocked inwardly towards the center of said ring and at an angle bringing the bore of the first bolt clip in axial alignment with the bore of said second bolt clip;

a bolt removably positioned in the bore of each bolt clip, connecting between the first bolt clip and the second bolt clip; and means associated with said bolt and said bolt clips for drawing together and moving apart the ends of said split ring.

BRIEF DESCRIPTION OF THE DRAWINGS

FIGS. 9–13, inclusive, are isometric views of embodiment bolt clip components of the invention.

FIG. 14 is a cross-sectional side elevation of an optional retainer component of the embodiment clips of FIGS. 9–13, inclusive.

DETAILED DESCRIPTION OF THE PREFERRED EMBODIMENTS OF THE INVENTION

Figure 1:
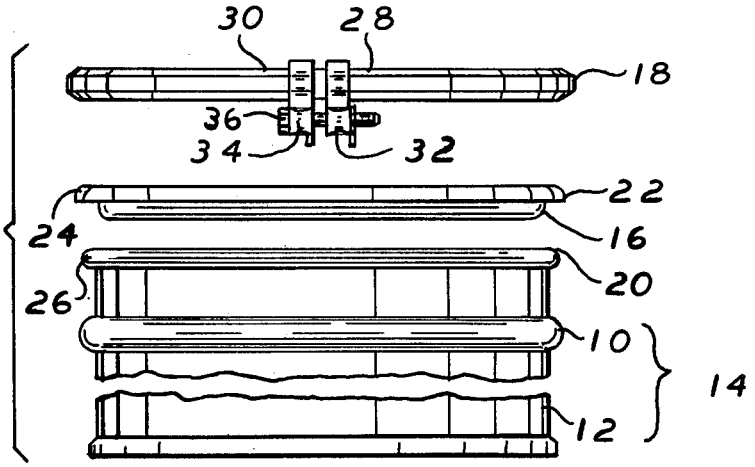
FIG. 1 is an isometric view of the upper and lower ends of a drum container showing the cover and closing ring assembly prior to assembly with the container.
Figure 2:
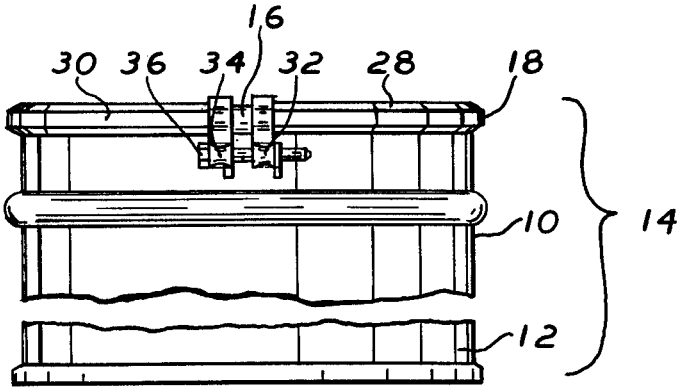
FIG. 2 is a view as in FIG. 1 but with cover and closing ring assembly secured to the container.

FIG. 1 is an isometric view of the upper end 10 and the lower end 12 of a drum container 14 showing the cover 16 and closing ring assembly 18 prior to assembly. In assembly, the container 14 chime 20 is overlapped by a peripheral flange 22 on the cover 16 which presents an upwardly facing rounded shoulder forming an upwardly facing first cam surface 24. The container 14 has a rounded shoulder on its outer surface spaced downwardly beneath the top of the chime 20 and forming a downwardly facing second cam surface 26. The split ring 18 is made of flexible material such as steel strapping of a diameter less than the diameter required to encircle the chime 20 with the cover 16 in place overlapping the chime 20 but sufficient to bring the ends 28, 30 in proximity to each other whereby the bolt clips 32, 34 mounted on ends 28, 30 of ring 18 are positioned to be connected by bolt 36. As shown in FIG. 2, a view as in FIG. 1 but with the cover 16 and ring 18 in place one can appreciate that the inner surface (not seen in FIGS. 1 and 2) of ring 18 is adapted to mate with and engage the cam surfaces 24, 26 and by constriction of the ring 18, secure cover 16 to the chime 20 of the drum container 14.

Figure 3:
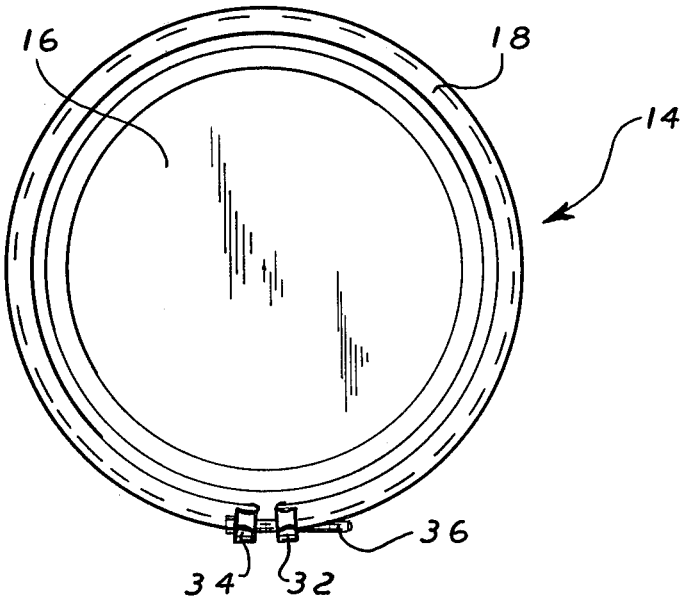
FIG. 3 is a view from above of the container shown in FIG. 2.

FIG. 3 is a view from above of container 14 as shown in FIG. 2. The bolt 36 is shown in an exaggerated position as a reference point. As will be discussed hereinafter, the bolt clips 32, 34 are so positioned that they and bolt 36 are substantially recessed under ring 18 so as not to interfere with the rolling of drum container 14.

Figure 4:
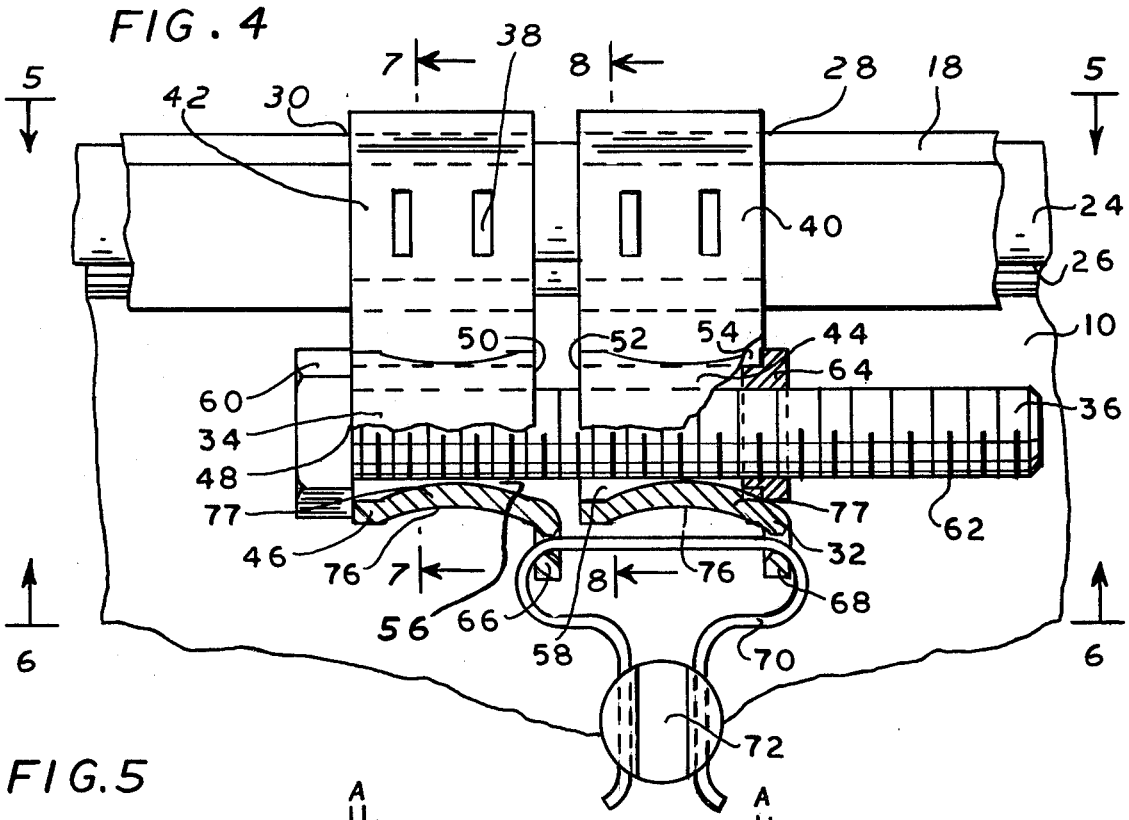
FIG. 4 is an enlarged side elevation of part of the closing ring assembly shown in FIGS. 1–3, partly sectioned.

FIG. 4 is an enlarged side elevation of part of the closing ring assembly 18 shown in FIGS. 1–3, partly sectioned. The bolt clips 32, 34 are fastened to split ring 18 on ends 28 and 30 by welds 38 to lug portions 40 and 42. The clips 32, 34 each comprise an upper, flat lug 40, 42 portion and an integral lower tube 44, 46 portion. The tubes 44, 46 each have flared, open ends 48, 50 and flared, open ends 52, 54 respectively. The ends are joined by bores 56, 58 respectively communicating therebetween. As also shown in FIG. 4, the bolt 36 connecting clips 32, 34 has a head 60 and is threaded, the threads 62 engaging a threaded retainer 64 in flared end 54 of clip 32. The head 60, threads 62 and retainer 64 comprise a means for drawing together split ring 18 ends 28, 30 and moving those ends apart by moving the bolt 36 in and out of the retainer 64. This constricts or releases the ring 18 in its association with the cover 16 and chime 20. The clips 32, 34 also have integral eyelets 66, 68 to receive a sealing wire 70 which is secured by a lead seal 72. The wire 70 and seal 72 provide an indication as to whether the cover has been removed and contents of container 14 tampered with.

Figure 5:
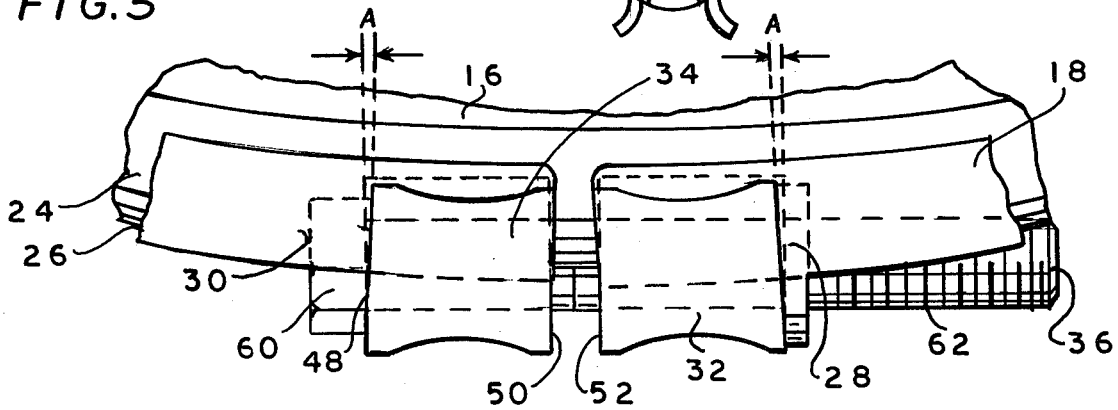
FIG. 5 is a view along lines 5—5 of FIG. 4.
Figure 6:
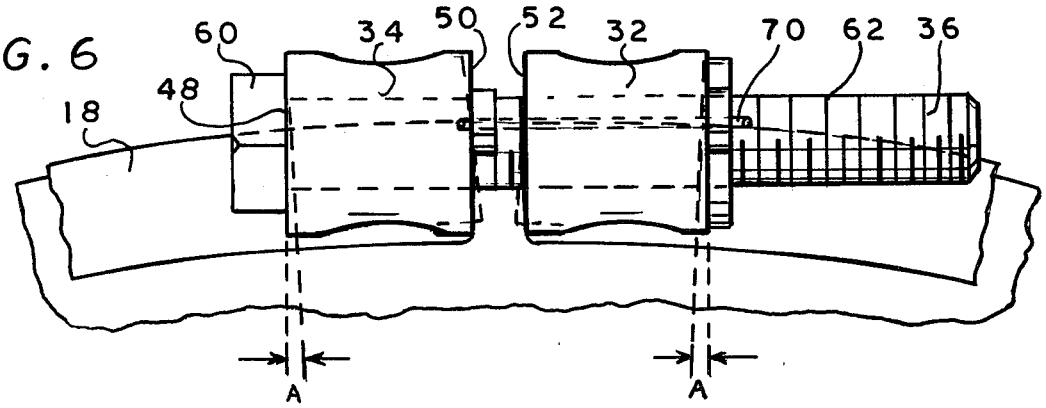
FIG. 6 is a view along lines 6—6 of FIG. 4.

FIG. 5 is a view along lines 5—5 of FIG. 4 and FIG. 6 is a view along lines 6—6 of FIG. 4. The views of FIGS. 5 and 6 show the mounting of clips 32, 34 so as to position them with the tube portions 44, 46 cocked inwardly towards the center of split ring 18, i.e.; under the ring 18 so that the drum container 14 may be rolled without interference from the clips 32, 34 or bolt 36. The clips 32, 34 are also mounted so tube portions 44, 46 are at an angle "A", to the perpendicular with ring 18 so as to bring the bore 58 of clip 32 in axial alignment with the bore 56 of clip 34, permitting insertion and removably positioning bolt 36 in bores 56, 58 as a connecting link between clips 32, 34.

Figure 8:
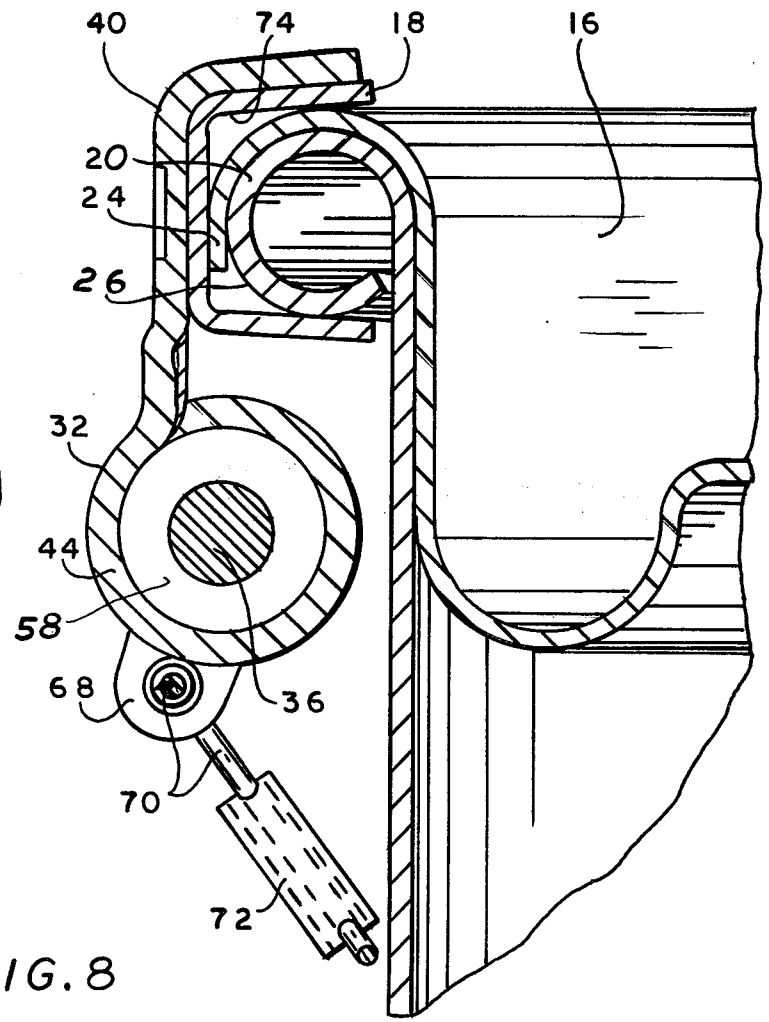
FIG. 8 is a view along lines 8—8 of FIG. 4.
Figure 7:
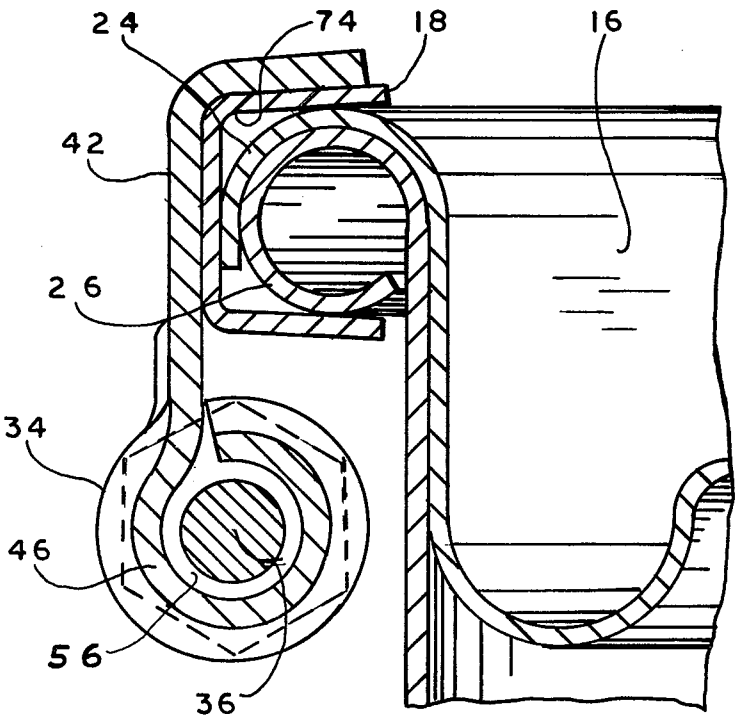
FIG. 7 is a view along lines 7—7 of FIG. 4.

FIGS. 7 and 8 are views along lines 7—7 and 8—8, respectively of FIG. 4 and show further details of the split ring 18 assembly. In particular, the inner surface 74 of the split ring 18 is shown to be a "U" shaped channel for enclosing the cam surfaces 24, 26. Also seen is the structure of clips 32, 34 as a single, unitary component comprising the flat lug portions 40, 42 secured to ring 18. The tube portions 44, 46 are formed by rolling the lower end of the flat lug inwardly to form a curl. The FIGS. 7 and 8 also show the position of tube portions 44, 46 beneath the protective parapet of ring 18.

In operation, the cover 16 is applied to the open end of drum container 14. The closing ringe 18 is then assembled around the cam surfaces 24, 26 while the bolt 36 holds ends 28, 30 of ring 18 apart. Thereafter the bolt 36 is rotated in retainer 64 to draw the ends 28, 30 of ring 18 together, constricting the diameter of split ring 18 to secure cover 16 to chime 20. The constricted split ring 18 exerts a resilient compressive force to hold cover 16 in sealing engagement with chime 20, thereby obviating leaks and sifting of contents from the container 14.

Figure 9:
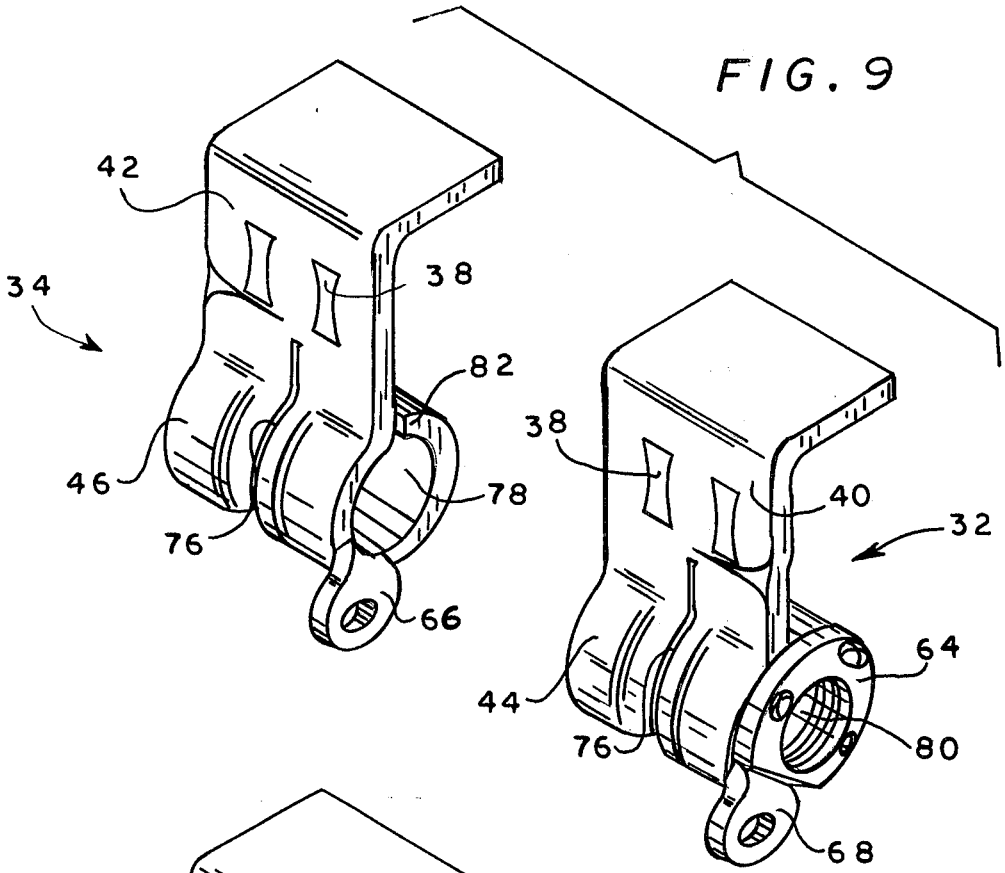

FIG. 9 is an isometric view of the embodiment bolt clips shown in FIG. 4. The clips 32, 34 comprise a flat piece of sheet metal which has been curled at one end to form the tubular portions 44, 46, respectively. The opposite end is left flat to form a leg or shank 40, 42 for attachment to the split ring 18 through the weld points 38. A groove 76 is formed in the tubular portions 44, 46 of each clip 32, 34 and extends into the lower portions of the flat portion 40, 42. Referring momentarily to FIG. 4 it can be seen that the grooves 76 in the outer surface of the bolt clips 32, 34 is in fact an inwardly directed depression forming a rib 77 on the inside walls 78, 80 of the bores formed by the tubular portions 44, 46. The effect of grooves 76 and rib 77 is to form flared open ends on the tubular portions 44, 46. This unique structure for the bolt clips 32, 34 provides distinct advantages for the closing ring assembly of the invention not found in the prior art devices. First, the flared ends of the tubular portions 44, 46 facilitate the insertion of a bolt into the bores defined by tubes 44, 46. This is a labor saving advantage particularly when power driven means to secure the bolt 36 to clips 32, 34 and of the bolt 36 is not properly inserted the bolt could be cross-threaded and rendered useless. Second, the groove 76 - rib 77 structure strengthens the tubular portions 44, 46. The rib 77 prevents the curled or tubular portion 44, 46 from being deformed if the end 82 of the curl should be pulled away from contact with the flat portion 40, 42 by any force. This would permit dislodgement of an inserted bolt 36 and destruction of the closing ring assembly. This commonly occurs with prior art closing ring assemblies when the bolt 36 is overtightened. Also, the curled end 82 is often sprung away from flat portions 40, 42 when metal drums carrying heavy products are dropped on the covers of other drums, causing unusual strain on the tubular portions 44, 46 and failure of the closing ring assembly.

The bolt 36 in association with the bolt clips 32, 34 serves as a means for drawing together the ends 28, 30 of the split ring 18 to constrict the ring 18 diameter and seal a drum cover 16 to the chime 20 of the drum container 14 as previously described. The same means, when counter-operated opens the ends, moving them apart to release the securement of the cover 16 to chime 20. In the preferred embodiment of the invention, such means comprises threads 62 on the bolt 36 (see FIG. 4) and a threaded nut retainer 64 mounted on one of bolt clips 32, 34. As shown in FIG. 9, a threaded retainer 64 is spot welded to the outside flared, open end of clip 32. The engagement between bolt 36 and threaded retainer 64 to open and close the ring 18 may be seen in FIG. 4. The structure of bolt clip 32 with attached retainer 64 is new and replaces the prior art stud insert or sleeve which was inserted into the bore of the tubular portion 44 and secured therein by flattening the end of such sleeve against the body of clip 32. It was common practice to flatten both ends of the insert in a mechanical press. In so doing, the pressure applied often changed or distorted the threads of the insert, requiring rethreading. This problem is obviated with the retainer 64 which may be welded as an unthreaded retainer and threaded insitu or before welding to the bolt clip 32. In either event, there is less potential for damage to the retainer 64 threads before use.

Figure 10:
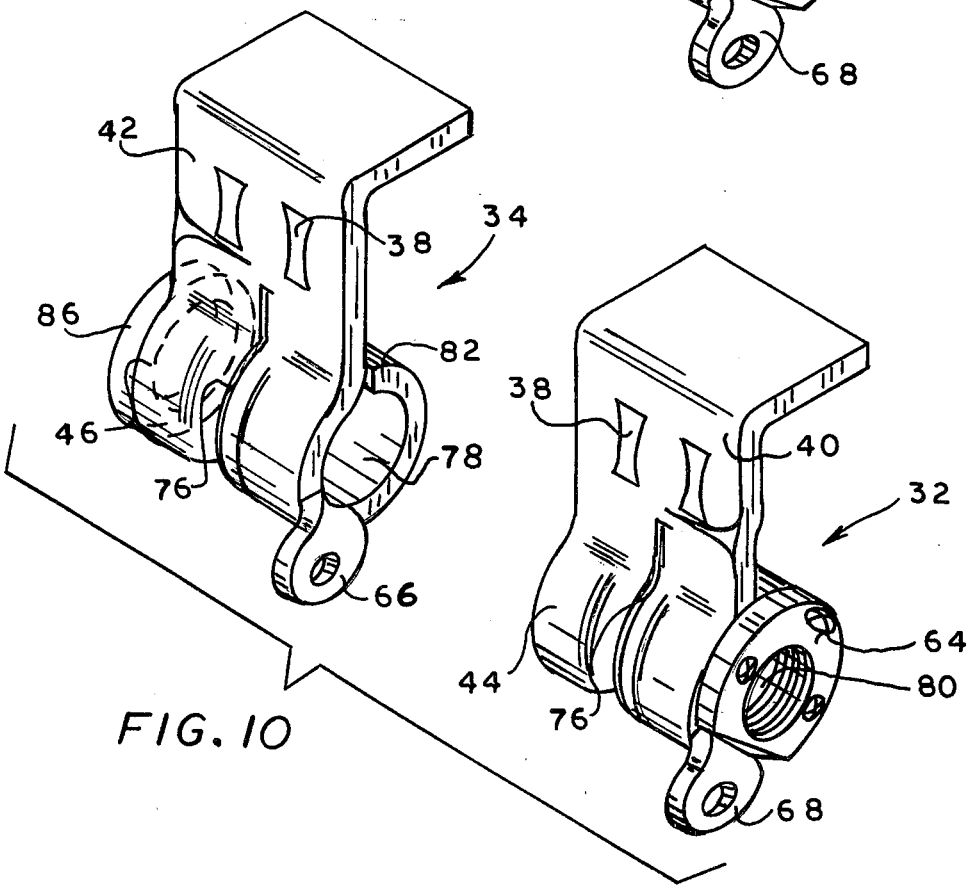
Figure 11:
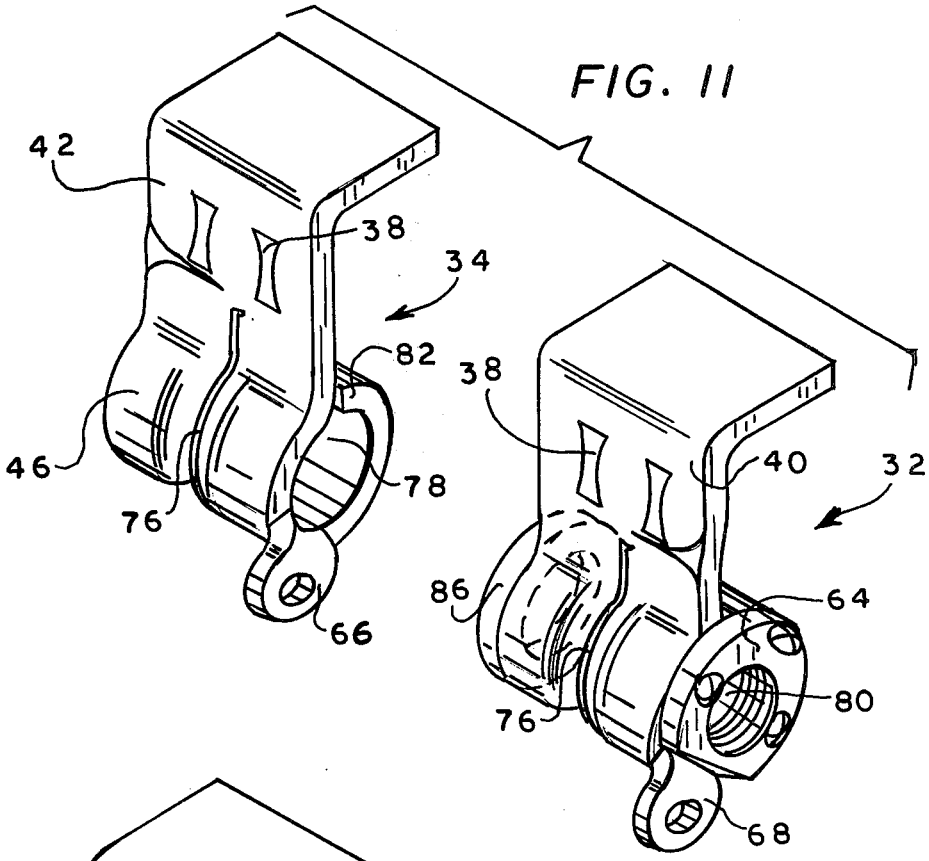
Figure 12:
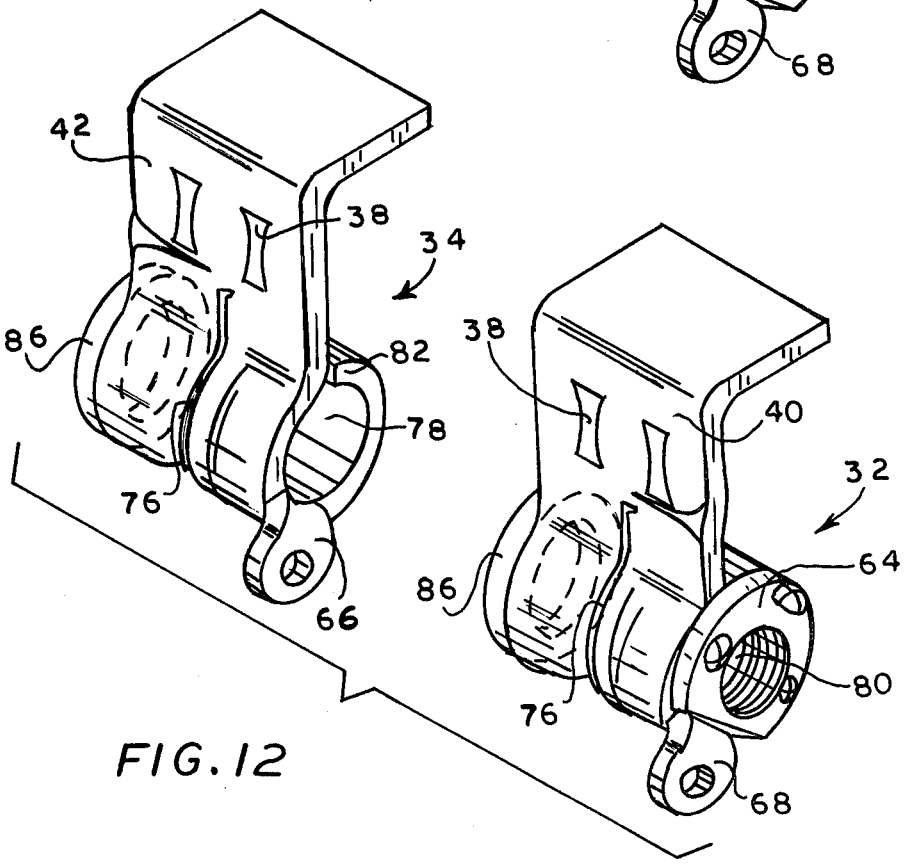

FIGS. 10–12, inclusive, are isometric views of alternate embodiment bolt clips 32, 34 of the invention differing only in the inclusion of an unthreaded retainer 86, positioned in various ends of the tubular portions 44, 46. The nonthreaded retainer 86 supports bolt 36 and further strengthens the bolt clip, preventing dislodgement of bolt 36 under pressure. FIG. 13 is a cross-sectional side elevation of the retainer 86 and shows that it comprises an annular ring 88 through which there passes bore 90. The bore 90 receives passage of the bolt 36 and flange 92 holds the bolt 36 by engagement with the bolt head 60 which can not pass through bore 90. The annular ring 88 is of a dimension to be received in the flared, open end of the tubular portion 44 or 46 of the bolt clips 32, 34. The non-threaded retainer 86 can also be threaded if so desired. As also shown in FIGS. 9–12, the seal wire receiving eyelets 68 are preferably an integrally formed part of the bolt clips 32, 34.

FIG. 14 is an isometric view of a preferred bolt clip 100 of the invention differing from bolt clips 32, 34 only in that the flared ends of the tubular portion of the clip 100 are separated by a considerably greater distance from each other by the groove 76. This embodiment clip 100 provides a high degree of structural strength for the tubular portion of the clip.

Those skilled in the art will appreciate that many modifications may be made to the above-described preferred embodiments without departing from the spirit and the scope of the invention. For example the bolt clips 32, 34, 100 may be fabricated in any size and of any thickness (gauge) of any type metal (mild or drop forged steel being preferred) to accomodate any size bolt 36 with any shaped head 60. The threaded nut retainer 64 can be produced in any diameter, in any width and with any number of threads.

What is claimed:

1. A closing ring assembly for releasably securing a cover on a drum container of the type in which the upper surface of the container chime is overlapped by a peripheral flange of the cover which presents an upwardly facing rounded shoulder forming an upwardly facing first cam surface, said container having a rounded shoulder in its outer surface spaced downwardly a distance beneath the top of the chime and forming a downwardly facing second cam surface, which comprises:

a split ring formed of a flexible material and being so constructed and arranged to encircle the top of the drum container with the cover in place and to bring the ends of said split ring in proximity to each other whereby bolt clips mounted on said ends as will be described hereinafter can be joined by a bolt, said split ring having an inner surface adapted to mate with and engage the first and second cam surfaces;

a first bolt clip mounted on said split ring adjacent to the first end of said split ring;

a second bolt clip mounted on said split ring adjacent to the second end of said split ring;

each of said bolt clips comprising a tube having flared, open first and second ends to facilitate insertion of the bolt and a bore communicating between said tube ends, each tube having an outer inwardly extending groove and internal inwardly extending rib operable to strengthen the tube and resist deformation thereof;

said mounting of the first and second bolt clips positioning them so as to be cocked inwardly towards the center of said ring and at an angle bringing the bore of the first bolt clip in axial alignment with the bore of said second bolt clip;

a threaded bolt removably positioned in the bore of each bolt clip, connecting between the first bolt clip and the second bolt clip; and threaded means associated with said bolt and said bolt clips for drawing together and moving apart the ends of said split ring.

2. The assembly of claim 1 wherein said flexible material is steel.

3. The assembly of claim 1 wherein said means for drawing together and moving apart the ends of said split ring comprise a threaded bolt retainer mounted in one of the flared ends of said second bolt clip, said retainer being adapted to engage the threads of said bolt.

4. The assembly of claim 1 wherein a non-threaded retainer is mounted in at least one flared end of said tube.

5. The assembly of claim 1, wherein each groove is substantially elongated in an axial direction to thereby provide a substantially high degree of structural strength for each tube.

* * * * *